United States Patent [19]
Moreau et al.
[11] 4,353,305
[45] Oct. 12, 1982

[54] KINETIC-ENERGY PROJECTILE

[75] Inventors: Pierre A. Moreau, Bourges; Jean C. Sauvestre, Saint-Doulchard, both of France

[73] Assignee: Etat Francais represente par le Delegue General pour l'Armement, Paris, France

[21] Appl. No.: 96,676

[22] Filed: Nov. 23, 1979

[30] Foreign Application Priority Data

Nov. 23, 1978 [FR] France ..... 78 33034

[51] Int. Cl.[3] ..... F42B 11/12
[52] U.S. Cl. ..... 102/519; 102/496
[58] Field of Search ..... 102/52, 67, 68, 92.1, 102/92.6, 501, 506, 517–519, 491–497, 374

[56] References Cited

U.S. PATENT DOCUMENTS

| | | | |
|---|---|---|---|
| 740,849 | 10/1903 | Groff | 102/52 |
| 3,213,792 | 10/1965 | Grenander et al. | 102/52 |
| 3,370,535 | 2/1968 | Permutter | 102/52 |
| 3,474,731 | 10/1969 | Thomanek | 102/52 |
| 3,853,058 | 12/1974 | Tartault | 102/68 |
| 4,032,335 | 6/1977 | Zapf et al. | 102/67 |
| 4,085,678 | 4/1978 | Heineker | 102/519 |

FOREIGN PATENT DOCUMENTS

| | | | |
|---|---|---|---|
| 2501416 | 8/1975 | Fed. Rep. of Germany | 102/67 |

*Primary Examiner*—Harold J. Tudor
*Attorney, Agent, or Firm*—Stevens, Davis, Miller & Mosher

[57] ABSTRACT

The present invention relates to a new kinetic-energy projectile. The projectile of the invention comprises a piercing head consisting of:

a head penetrating means
a main penetrating means
and a spacing means located between the head penetrating means and the main penetrating means.

The projectile of the invention is used to pierce light, heavy and strongly sloping armor.

5 Claims, 5 Drawing Figures

KINETIC-ENERGY PROJECTILE

The present invention relates to a kinetic-energy projectile, in particular to an arrow type, applicable to light and heavy targets, whether strongly sloping or not, and following piercing generating very large effects at the rear.

The kinetic-energy projectiles and in particular the arrow type projectiles are designed to destroy with a high hit probability any presently existing battle tank. So-called "heavy" targets representative of these tanks are used as references to test the intrinsic piercing value of a kinetic-energy projectile, and these are: the simple heavy tank (S.C.L) targets, double heavy tank (D.C.L.) targets, and triple heavy tank (T.C.L.) targets. Other so-called new targets, either passive (composite or not) such as for instance the commercialized English armor called CHOBHAM armor, or active, are effective with respect to certain kinetic-energy projectiles.

Faced with the difficulty in piercing such targets, projectile design has emphasized products which better concentrate the kinetic energy at impact, that is, having the highest possible ratio of impact kinetic-energy to cross-section or mid-frame of the projectile. To that end, dense materials with high-grade properties such as tungsten or uranium alloys were required to ensure the projectiles have good mechanical strength both when in the cannon phase and at impact.

The kinetic energy projectiles using such materials and optimized against various homogeneous armors generate slight effects at the rear as regards light armor, deliver average piercing results on strongly sloping targets (angle of incidence exceeding 70°), and mediocre ones as regards multiple targets.

To ensure multimission piercing of light, heavy and multiple targets, projectiles with complete lining of the penetrating means are known, with an explosive charge located at the rear of the penetrating means and a rupture fuze fashioned in the ballistic cone.

The projectiles with complete penetrator lining as shown in FIG. 1 are so designed that the penetrator 1 is housed in a sleeve 2 of a ductile but strong material. This sleeve allows the penetrator to remain intact, either at impact or by reflecting the shock wave at impact.

This technique allows piercing multiple targets under better conditions but the compactness of the penetrator affects the piercing of homogeneous targets and considerably reduces the effectiveness behind light armor.

The technique used in the projectiles shown in FIG. 2 consists in obtaining large rearward effects behind light armor. To achieve this result, an explosive confined charge 3 is located inside and to the rear of penetrator 4 and will be initiated by known means a given distance behind the light armor.

This projectile suffers from several drawbacks. The location in the rear of the projectile of the exposive charge 3 contained in an envelope 5 requires said envelope to be of a minimum thickness e, as the rear part of the projectile is highly stressed during the cannon phase. On the other hand the given-thickness envelope 5 can only contain a minimal amount of explosive considering that its outside diameter must be substantially equal to the diameter (D) of the penetrator. Consequently the ratio of the mass of the envelope to the mass of the explosive is low, whereby only mediocre bursting effectiveness will obtain. Another drawback arises from the difficulty in varying the initiation of the explosive charge depending on the type of target to be pierced, a given projectile being unable to be simultaneously effective against simple, double or triple heavy tank targets. Lastly the overall operational reliability is uncertain.

Another practical technique consists in a rupturing fuze 3 (FIG. 6) in the ballistic cone 7 of the projectile so as to make it more effective against multiple targets. At impact, the ballistic cone fractures while piercing the first plate, whereupon the remainder of the penetrator enters the perforation of the first plate without being interfered with and pierces the second and any third plate without being destabilized.

These projectiles suffer from three major drawbacks. This the characteristic sizes of the rupturing fuzes are related to the nature of the multiple target being met, whereby a projectile designed for double targets will be found poorly effective against triple targets. On the other hand, the effects behind light armor are negligible. Lastly the chances of ricocheting off strongly sloping targets are high.

The object of the present invention is to remedy the characteristic drawbacks of the known projectiles. The object of the invention therefore is to create a projectile permitting piercing multiple targets in excellent manner, piercing the highly sloping targets without risk of ricochet, and achieving effects behind light armor, which are high efficiency, density and space-distribution.

The kinetic-energy piercing projectile of the invention comprise a piercing head consisting of a head penetrator, a main penetrator and a spacing means between the head and main penetrators.

In another characteristic, the spacing means is made of a ductile material or consists of a screen, for instance a metal screen.

The spacing means constitutes an envelope defining a space in which are located dense-material sub-projectiles.

The ends of the head penetrator and of the main penetrator fastened in the envelope are of an appropriate shape to assist in the radial ejection of the sub-projectiles, for instance a conical shape.

In a variation, the explosive is located in the central region of the space occupied by the sub-projectiles.

The sub-projectiles are embedded in a binder for instance a paraffin-based binder, a wax-based or explosive-based binder, or in a binder consisting of a metal powder sintered with the sub-projectiles.

The sub-projectiles are for instance granules or hard-material competing solids such as tungsten balls.

The invention shall be better understood in relation to a specific description of two illustrative embodiments of a projectile of the invention.

Figures attached to this description will specify the state of the art and two modes of implementation of the invention.

Thus FIGS. 1,2 and 3 define the state of the art such as described at the beginning of the present specification.

Figures 1, 2, 3, 4, 5:
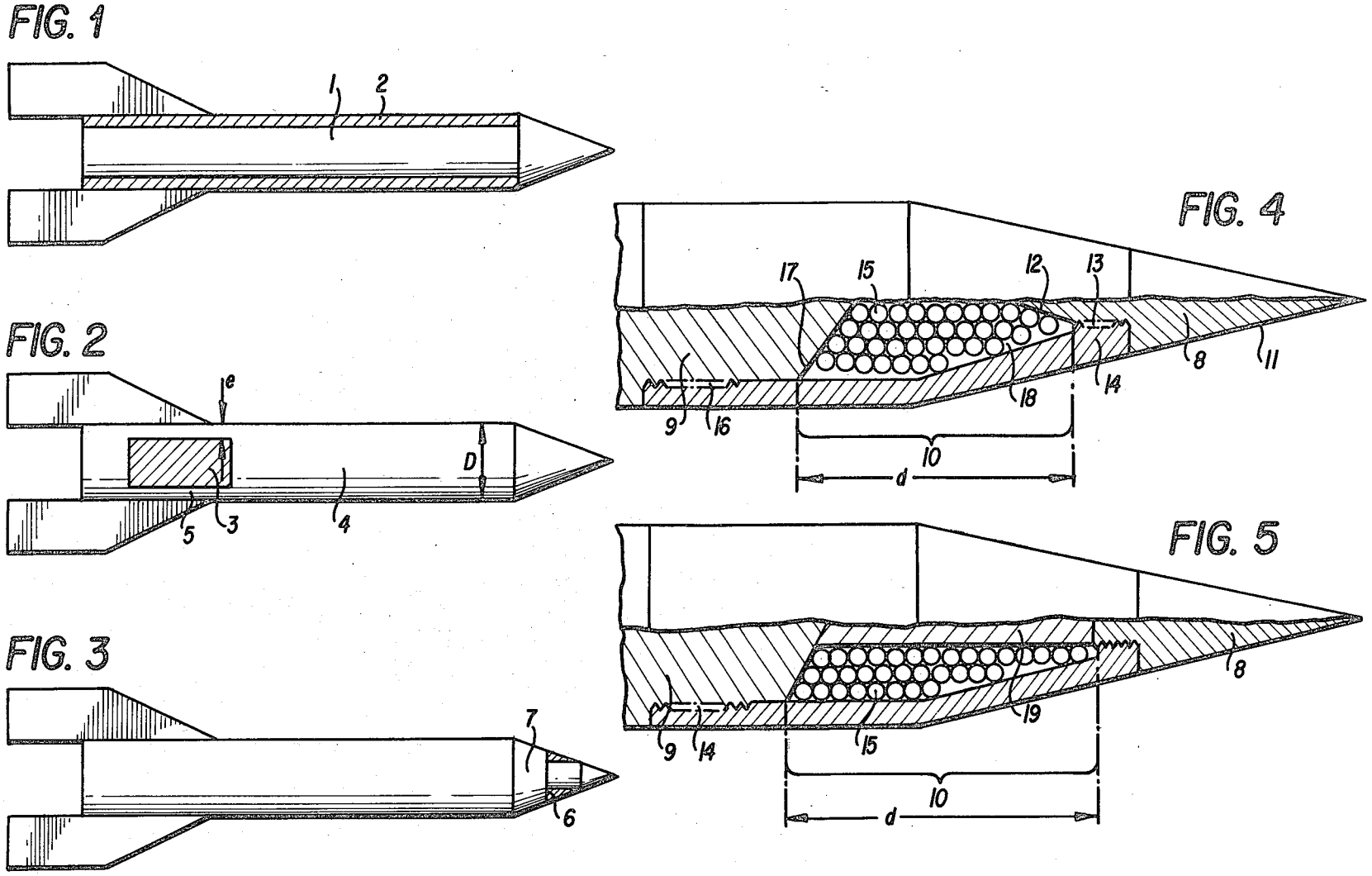
FIG. 4 represents a particular embodiment of the piercing head of a projectile of the invention.
FIG. 5 represents a variation of the piercing head shown in FIG. 4.

The piercing head of the projectile of the invention such as it is shown in FIG. 4 comprises:

a head penetrator 8, a main penetrator 9, a disperser 10.

The head penetrator is made of a dense material such as a tungsten or uranium alloy and is in the shape of a cone 11 at the front so as to improve the projectile's penetration coefficient in air. At the rear, the head penetrator comprises a cone 12 called hammer. The head penetrator 8 is fastened for instance by means of a thread 13 to a spacing means 14 of which the front end completes the ballistic cone of the projectile. This spacing means 14 forms an envelope in which are located sub-projectiles 15 consisting of metal granules such as tungsten balls.

The spacing means 14 is made of a sufficiently strong material to allow the head penetrator to fulfill its role and sufficiently fragile not to hamper the ejection of the balls. The material used may be a light alloy. In another embodiment, the spacing means may consist of a metal screen.

The main penetrator 9 comprises a threaded part 15 to which is tightened the spacing means 14. The spacing means 14 permits retaining a distance (d) between the head and main penetrators, which in this particular embodiment is about 1.3 caliber. The main penetrator 9 is made of a dense material in known manner and comprises at its front end a conical part 17 called anvil.

To prevent dynamic imbalance that might affect projectile stability, the sub-projectiles are held in place by a binder 18, which may be paraffine- or wax-based, or based on a metal powder sintered with the sub-projectiles.

The set consisting of sub-projectiles 15, the binder 18, the spacing means 14 and the conical parts 12 and 17 of the penetrators constitutes the disperser 10.

A variation of the piercing head, shown in FIG. 5, arranges an explosive charge 19 in the central part of the envelope 14 which is initiated by known means or by shock during projectile impact on the target. This explosive charge is a means for dispersing the sub-projectiles 15 surrounding it, in the same manner as by the previously described hammer and anvil.

When the projectile of the invention hits multiple targets such as the triple heavy tank target, the head penetrator 8 pierces the first plate by detaching itself from the main penetrator. During this first piercing, the material of the metal envelope 14 of the disperser acts as a shock absorber and permits stopping the reflected shock wave. The main penetrator 9 is neither deflected nor ruptured and passes through the perforation achieved by the head penetrator and thus can pierce the second and third plates. In this instance the effects behind the armor are due to the remnants of the penetrator and the bursting of the last armor plate encountered.

When the projectile hits light armor, for instance a target made of a light alloy 30 to 40 mm thick or of steel 10 mm thick, the head penetrator 8 pierces the armor, the main penetrator 9 assuming a higher speed than the head penetrator. The sub-projectiles held in the envelope of disperser 10 will be forced out radially due to the relative motion of hammer 12 toward anvil 17 as regards the projectile described in FIG. 4, or due to the explosive as regards the projectile of FIG. 5. The dispersion of the sub-projectiles takes place just behind the light armor, their radial speed being combined with the linear speed of the projectile. The sub-projectiles thus dispersed and combined with the burst of the armor and the remnants of the main penetrator produce very powerful effects in the rear and within a solid angle as high as 150°.

Lastly the projectile of the invention removes the problem of target sloping by eliminating the risks of ricochets. While at impact the head penetrator tends to ricochet due to the target slope, it causes on the other hand a groove or scoring in the plate due to its motion. As in the case of multiple targets, the envelope of the disperser acts as a shock absorber and stops the shock wave reflected by the target. The main penetrator therefore is neither deflected nor ruptured and enters the groove fashioned by the head penetrator, the slope of the encountered surface being considerably reduced.

We claim:

1. A piercing kinetic-energy projectile, particularly of the arrow type applicable to light or heavy targets, comprising:

a heat penetrator;

a main penetrator;

a spacing means, said head and main penetrators being connected to said spacing means which retains a distance between the head and main penetrators and constitutes an envelope, said spacing means acting as a shock absorber to absorb the shock wave reflected by the target upon impact of said head penetrator, the ends of the main and head penetrators fastened in the envelope having a conical shape; and a plurality of dense material sub-projectiles located in a space bounded by said spacing means and the ends of the main and head penetrators.

2. A piercing kinetic-energy projectile as defined in claim 1, wherein an explosive is located in the central part of the space occupied by the sub-projectiles.

3. A piercing kinetic-energy projectile as defined in claim 1, wherein the sub-projectiles are embedded in a binder.

4. A piercing kinetic-energy projectile as defined in claim 3, wherein the sub-projectiles are embedded in a parafin-based, wax-based or explosive-based binder.

5. A piercing kinetic-energy projectile as defined in claim 3, wherein the sub-projectiles are embedded in a binder consisting of a metal powder centered with the sub-projectiles.

* * * * *